US012359604B2

(12) United States Patent
Yamada et al.

(10) Patent No.: US 12,359,604 B2
(45) Date of Patent: Jul. 15, 2025

(54) ENGINE

(71) Applicant: SUZUKI MOTOR CORPORATION, Hamamatsu (JP)

(72) Inventors: Shinichi Yamada, Hamamatsu (JP); Yuki Ryu, Hamamatsu (JP); Shogo Kousaka, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 18/820,905

(22) Filed: Aug. 30, 2024

(65) Prior Publication Data

US 2025/0137397 A1 May 1, 2025

(30) Foreign Application Priority Data

Oct. 26, 2023 (JP) ..... 2023-183739

(51) Int. Cl.
*F01N 13/00* (2010.01)

(52) U.S. Cl.
CPC ..... *F01N 13/008* (2013.01); *F01N 2590/04* (2013.01)

(58) Field of Classification Search
CPC ..... F01N 13/008; F01N 13/08; F01N 13/009; F01N 13/14; F01N 2590/04; F01N 2260/20; F01N 2340/04; F01N 2560/025
USPC ..... 60/276
See application file for complete search history.

(56) References Cited

U.S. PATENT DOCUMENTS

| | | | | |
|---|---|---|---|---|
| 2007/0193812 | A1 | 8/2007 | Adachi et al. | 180/309 |
| 2010/0032226 | A1 | 2/2010 | Yokoi | 180/229 |
| 2020/0049055 | A1 | 2/2020 | Bluemelhuber et al. | F01N 13/008 |
| 2022/0220883 | A1* | 7/2022 | Muraoka | F01N 3/101 |

FOREIGN PATENT DOCUMENTS

| | | | |
|---|---|---|---|
| BR | PI 0700424-9 | A | 11/2007 |
| DE | 3 655 634 | B1 | 6/2018 |
| JP | 3489242 | B2 | 1/2004 |
| JP | 7338145 | B2 | 8/2023 |
| WO | WO 2021/220299 | A1 | 11/2021 |
| WO | WO 2023/189962 | A1 | 10/2023 |

OTHER PUBLICATIONS

Extended European Search Report dated Jan. 21, 2025, issued by the European Patent Office in corresponding application EP 24199401.1.

* cited by examiner

*Primary Examiner* — Mark A Laurenzi
*Assistant Examiner* — Kelsey L Stanek
(74) *Attorney, Agent, or Firm* — Stein IP, LLC

(57) ABSTRACT

An engine for a straddle-type vehicle. The straddle-type vehicle is to be mounted on a vehicle frame in which a down frame extends downward from a head pipe. The engine includes a cylinder head having an exhaust port formed thereon, an exhaust pipe connected to the exhaust port of the cylinder head, and an exhaust gas sensor attached to the exhaust pipe. The exhaust pipe extends downward passing through a first lateral side of the down frame, crosses a front side of the down frame, and extends upward passing through a second lateral side of the down frame. A part of the exhaust pipe that crosses the down frame is a straight portion. The exhaust gas sensor is attached to the straight portion and overlaps the down frame from the front side.

7 Claims, 6 Drawing Sheets

ENGINE

CROSS-REFERENCE TO RELATED APPLICATIONS

This application is based on and claims priority under 35 USC 119 from Japanese Patent Application No. 2023-183739 filed on Oct. 26, 2023, the entire content of which is incorporated herein by reference.

TECHNICAL FIELD

The present disclosure relates to an engine.

BACKGROUND ART

An engine for a straddle-type vehicle has an exhaust pipe that is curved in a U-shape in front of a down tube (see, for example, JP3489242B). In the engine described in JP3489242B, a cylinder is disposed on a crank case, and a cylinder head is disposed on the cylinder. An exhaust port is formed in a front surface of the cylinder head, and an exhaust pipe extends downward from the exhaust port toward the crank case. In front of the crank case, the exhaust pipe is curved upward in a U-shape and extends to the cylinder, and the exhaust pipe passes through a lateral side of the cylinder and extends to a rear side of the vehicle and then connected to a muffler.

Incidentally, an exhaust gas sensor is attached to the exhaust pipe, but if the exhaust pipe has many bends, the flow of exhaust gas is deviated, thereby deteriorating detection accuracy of the exhaust gas sensor. Depending on where the exhaust gas sensor is disposed, there is a high risk of damage to the exhaust gas sensor or a lead wire.

SUMMARY OF INVENTION

Aspect of non-limiting embodiments of the present disclosure relates to provide an engine capable of reducing the risk of damage to the exhaust gas sensor in a model in which the exhaust pipe passes through the lateral side of the cylinder.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an engine for a straddle-type vehicle to be mounted on a vehicle frame in which a down frame extends downward from a head pipe, the engine including:

a cylinder head having an exhaust port formed thereon;

an exhaust pipe connected to the exhaust port of the cylinder head; and an exhaust gas sensor attached to the exhaust pipe, in which the exhaust pipe extends downward passing through a first lateral side of the down frame, crosses a front side of the down frame, and extends upward passing through a second lateral side of the down frame, a part of the exhaust pipe that crosses the down frame is a straight portion, and the exhaust gas sensor is attached to the straight portion and overlaps the down frame from the front side.

BRIEF DESCRIPTION OF DRAWINGS

Exemplary embodiment(s) of the present invention will be described in detail based on the following figures, wherein.

DESCRIPTION OF EMBODIMENTS

An engine according to one aspect of the present disclosure is mounted on a vehicle frame of a straddle-type vehicle. An exhaust port is formed in a cylinder head of the engine, and an exhaust pipe is connected to the exhaust port of the cylinder head, and an exhaust gas sensor is attached to the exhaust pipe. A down frame extends downward from a head pipe of the vehicle frame, and the exhaust pipe extends downward through one lateral side of the down frame. After crossing a front side of the down frame, the exhaust pipe passes through the other lateral side of the down frame and extends upward. A part of the exhaust pipe that crosses the down frame is a straight portion, and the exhaust gas sensor is attached to the straight portion and overlaps the down frame from the front side. The exhaust gas sensor is attached to the straight portion where the flow of exhaust gas is less deviated, and the exhaust gas sensor overlaps the down frame from the front side and is approximately perpendicular to the straight portion. The detection accuracy is improved by directing the detection end of the exhaust gas sensor approximately perpendicular to the flow of the exhaust gas. The straight portion of the exhaust pipe vibrates less than a bent portion, allowing the exhaust gas sensor to be stably supported, and the exhaust gas sensor is positioned on the inside in the vehicle width direction, thereby reducing the risk of damage to the exhaust gas sensor when the vehicle rolls over. By routing the lead wire of the exhaust gas sensor along the down frame, it is possible to prevent vibration of the lead wire and reduce the risk of damage to the lead wire.

EMBODIMENT

Figure 1:
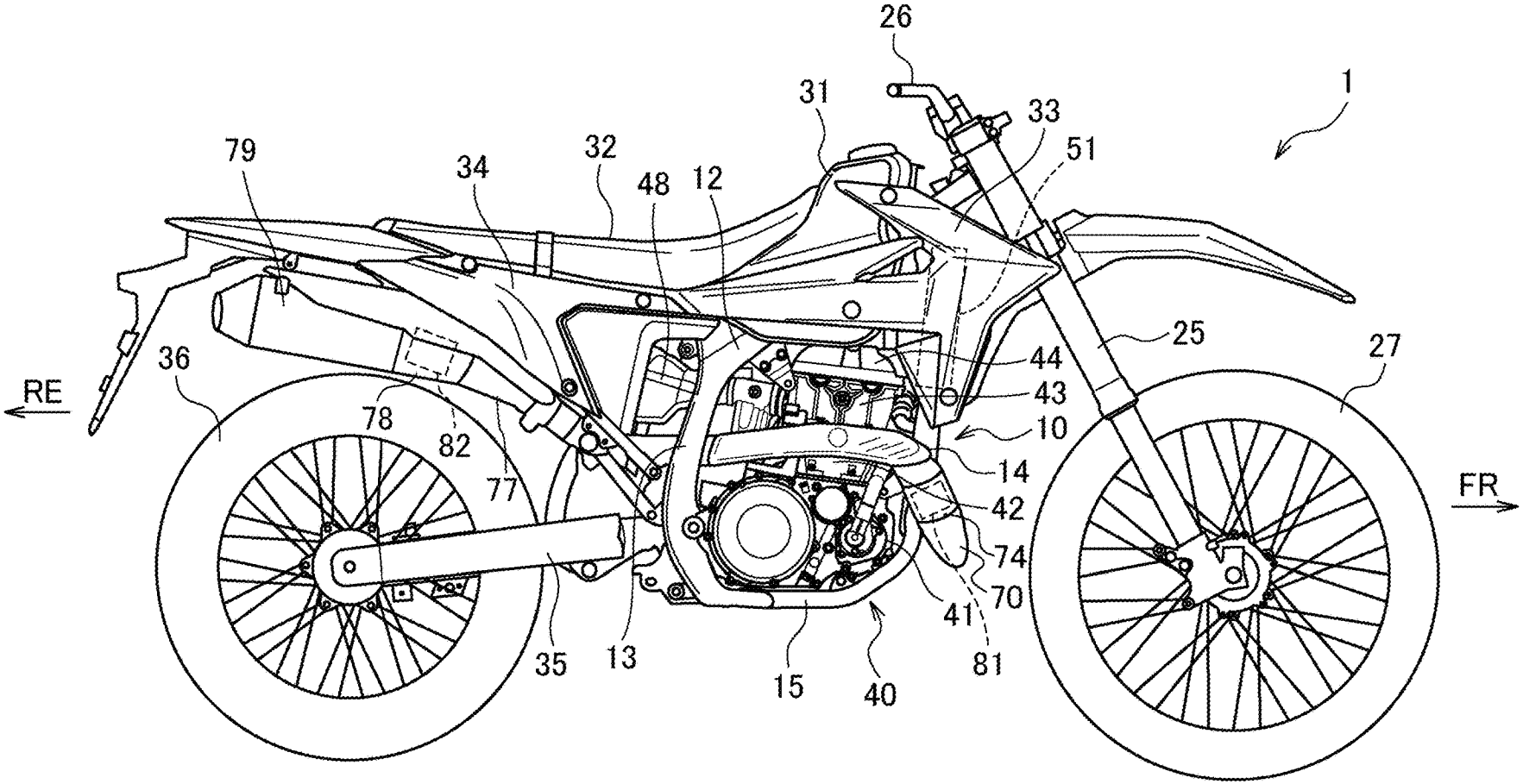
FIG. 1 is a right side view of a straddle-type vehicle according to an embodiment.

Hereinafter, a straddle-type vehicle according to the present embodiment will be described with reference to the accompanying drawings. FIG. 1 is a right side view of the straddle-type vehicle according to the present embodiment. In the following drawings, an arrow FR indicates a vehicle front side, an arrow RE indicates a vehicle rear side, an arrow L indicates a vehicle left side, and an arrow R indicates a vehicle right side.

As shown in FIG. 1, a straddle-type vehicle 1 is implemented by mounting various components such as an engine 40 and an electrical system on a vehicle frame 10. A pair of main frames 12 extend obliquely rearward and downward from a head pipe 11 (see FIG. 2) of the vehicle frame 10, and rear portions of the pair of main frames 12 form a pair of body frames 13 bent downward. A down frame 14 extends downward from the head pipe 11, and an under loop 15 bent rearward is connected to a lower portion of the down frame 14. Rear ends of the pair of under loops 15 are connected to lower portions of the pair of body frames 13, so that the vehicle frame 10 is formed into a cradle shape.

A front fork 25 is steerably supported by the head pipe 11 via a steering shaft (not shown). A handle 26 is provided at an upper portion of the front fork 25, and a front wheel 27 is rotatably supported by a lower portion of the front fork 25. A fuel tank 31 is placed over upper portions of the pair of main frames 12, and the main frames 12 and the fuel tank 31 are covered by a front side cover 33 from a lateral side. A seat 32 is disposed behind the fuel tank 31, and a seat frame 16 (see FIG. 2) that supports the seat 32 from below is covered by a rear side cover 34 from a lateral side.

A swing arm 35 is swingably supported on the body frame 13. The swing arm 35 extends rearward from the body frame 13, and a rear wheel 36 is rotatably supported at a rear end of the swing arm 35. The engine 40 is a four-stroke single-cylinder engine, and is suspended inside the vehicle frame 10 via a plurality of suspension brackets. A cylinder assembly in which a cylinder 42, a cylinder head 43, and a cylinder head cover 44 are stacked is attached to an upper portion of a crank case 41 of the engine 40. At a rear side of the cylinder head 43, an air cleaner 48 is disposed.

Left and right radiators 51, 55 (only the right radiator 51 is shown in FIG. 1) are positioned in front of the cylinder head 43. The left and right radiators 51, 55 are attached to the down frame 14. An exhaust pipe 70 extends downward from a left side of a front surface of the cylinder head 43. The exhaust pipe 70 passes through a right lateral side of the cylinder 42 and is connected to a muffler 79 at a rear side of the vehicle. A primary catalyst case 74 is formed in the exhaust pipe 70 in front of the crank case 41. A secondary catalyst case 78 is formed in the exhaust pipe 70 behind the air cleaner 48. The primary catalyst case 74 accommodates a primary catalyst 81. The secondary catalyst case 78 accommodates a secondary catalyst 82.

When the primary catalyst case 74 is provided in front of the crank case 41, it is difficult to provide an oxygen sensor on an upstream side or a downstream side of the primary catalyst case 74. In the straddle-type vehicle 1 of the present embodiment, the exhaust pipe 70 has many bends, which causes the flow of the exhaust gas inside the exhaust pipe 70 to deviate, resulting in poor detection accuracy depending on a position where the oxygen sensor is disposed. There is a high risk of damage to the oxygen sensor and a lead wire in front of the crank case 41. Therefore, in the present embodiment, the oxygen sensor is provided at the straight portion in the exhaust pipe 70, where the flow of the exhaust gas is less deviated and the risk of damage is low, and at a position overlapping the down frame, which serves as a route for routing the lead wire, from the front side.

Figure 2:
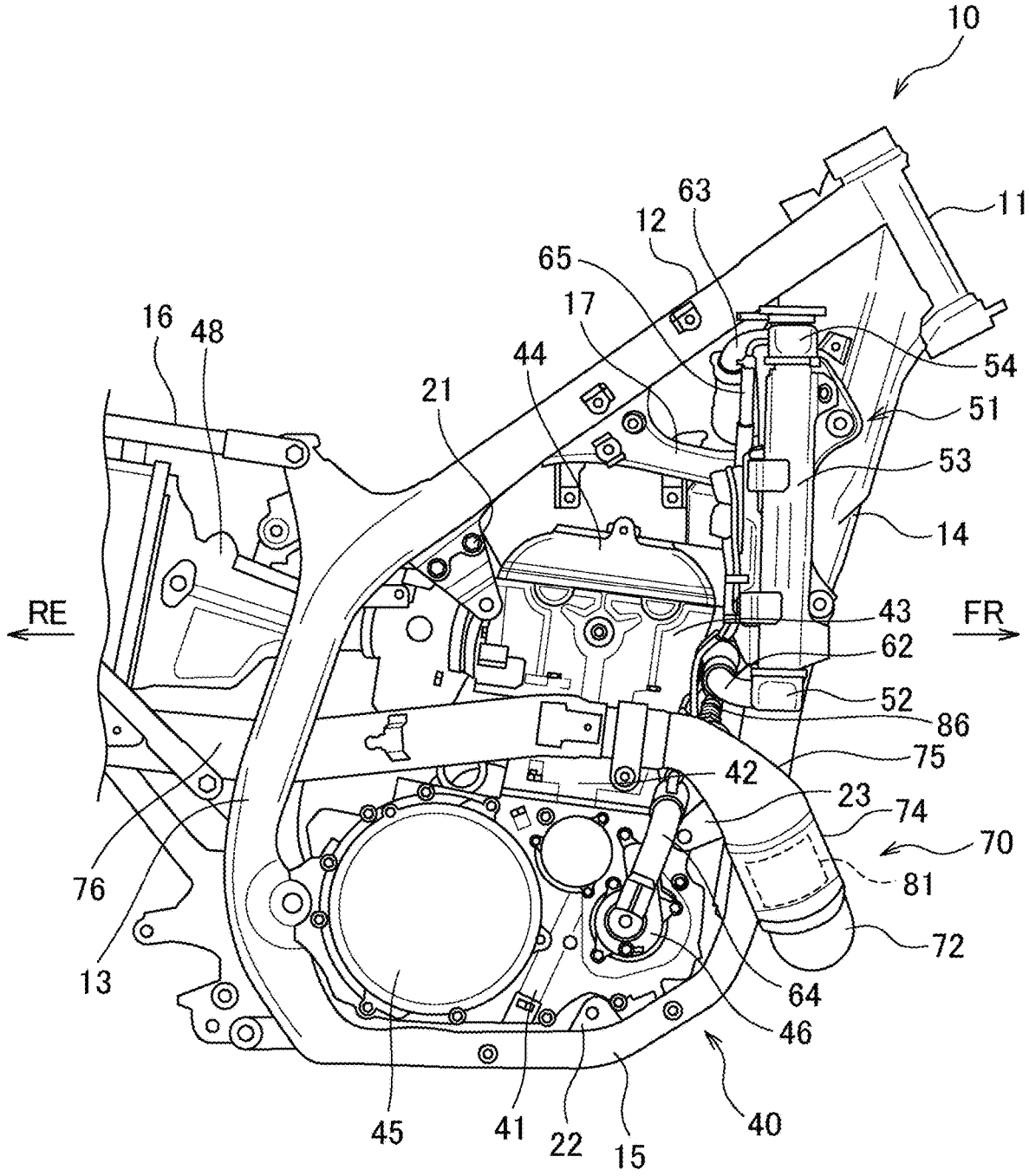
FIG. 2 is a right side view of a periphery of an engine according to the present embodiment.
Figure 3:
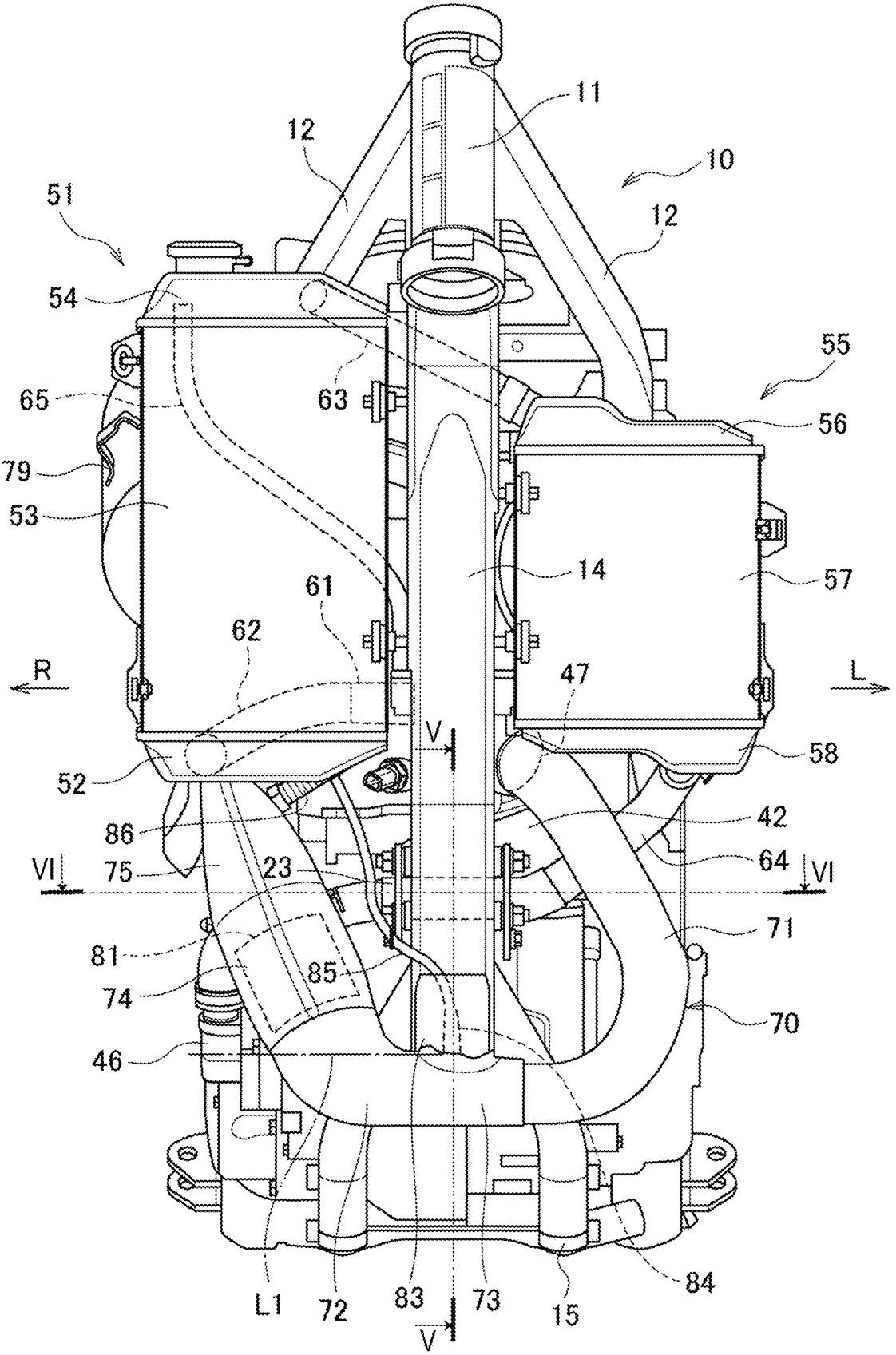
FIG. 3 is a front view of the periphery of the engine according to the present embodiment.
Figure 4:
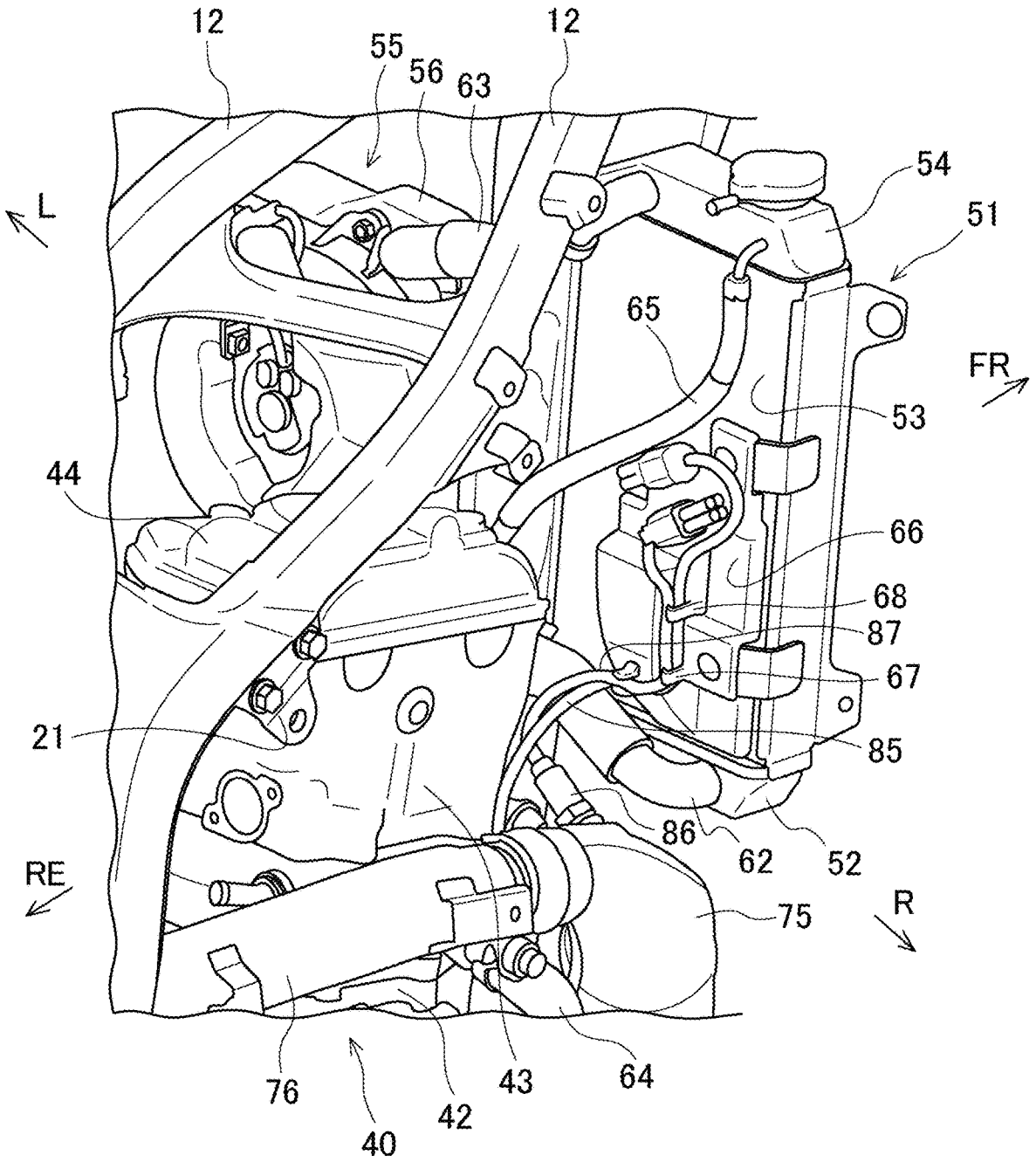
FIG. 4 is a perspective view of the periphery of the engine according to the present embodiment when obliquely viewed from a rear and right side.

Peripheral structures of the engine will now be described with reference to FIGS. 2 to 4. FIG. 2 is a right side view of a periphery of the engine according to the present embodiment. FIG. 3 is a front view of the periphery of the engine according to the present embodiment. FIG. 4 is a perspective view of the periphery of the engine according to the present embodiment when obliquely viewed from a rear and right side.

As shown in FIG. 2, the pair of main frames 12 and the down frame 14 are connected to each other via bridge tubes 17 for reinforcement at an upper portion of the vehicle frame 10. Below the bridge tubes 17, the engine 40 is suspended from the vehicle frame 10 by suspension brackets 21 to 23. A clutch cover 45 is attached to a right side surface of the crank case 41 of the engine 40. A water pump 46 is provided in front of the clutch cover 45. A discharge port of the water pump 46 is connected to a cooling passage in the crank case 41. A cooling water is delivered from the water pump 46 to the inside of the cylinder 42 and to a water jacket in the cylinder head 43.

As shown in FIGS. 2 and 3, the right radiator 51 and the left radiator 55 are provided in front of the cylinder head 43 with the down frame 14 at a center of the vehicle interposed between the right radiator 51 and the left radiator 55. The right radiator 51 is formed to be larger than the left radiator 55. In the right radiator 51, a right inlet tank 52 is provided below a right radiator core 53, and a right outlet tank 54 is provided above the right radiator core 53. In the left radiator 55, a left inlet tank 56 is provided above a left radiator core 57, and a left outlet tank 58 is provided below the left radiator core 57.

A thermostat cover 61 is provided on a front surface of the engine 40. A thermostat (not shown) is provided inside the thermostat cover 61. The right inlet tank 52 is connected to the thermostat cover 61 via an inlet hose 62. The right outlet tank 54 and the left inlet tank 56 are connected to each other via an inter-radiator hose 63. The left outlet tank 58 is connected to the water pump 46 via an outlet hose 64. An upper portion of the thermostat cover 61 is connected to the right outlet tank 54 via an air vent hose 65.

In the right radiator 51, the cooling water flows upward from the right inlet tank 52 toward the right outlet tank 54, and while the cooling water passes through the right radiator core 53, the heat of the cooling water is radiated into the air. The cooling water is sent from the right outlet tank 54 to the left inlet tank 56, through the inter-radiator hose 63. In the left radiator 55, the cooling water flows downward from the left inlet tank 56 toward the left outlet tank 58, and while the cooling water passes through the left radiator core 57, the heat of the cooling water is radiated into the air. The heat of the cooling water is radiated in two stages by the right radiator 51 and the left radiator 55, so that cooling efficiency is improved.

The cylinder head 43 and an intermediate portion of the outlet hose 64 are connected via a bypass hose (not shown). A bypass passage is formed by the bypass hose that bypasses the right radiator 51 and the left radiator 55. A bypass passage is configured to return the cooling water from the cylinder head 43 (upstream of the thermostat) to the water pump 46. In a case where a temperature of the cooling water is lower than a predetermined temperature, the thermostat closes and the cooling water is returned from the cylinder head 43 through the bypass hose to the water pump 46. In a case where the temperature of the cooling water is equal to or higher than the predetermined temperature, the thermostat opens, and the cooling water flows into the right radiator 51 and the left radiator 55 to cool the engine 40.

An exhaust port 47 obliquely facing a left and lower side is formed in the front surface of the cylinder head 43, and the exhaust pipe 70 is connected to the exhaust port 47. The exhaust pipe 70 extends downward from the exhaust port 47 passing through the left lateral side of the down frame 14, crosses a front side of the down frame 14, and then extends upward passing through the right lateral side of the down frame 14. The exhaust pipe 70 is curved into a U-shape using a space in front of the vehicle body, so that a radius of curvature of a curved portion of the exhaust pipe 70 becomes large, and exhaust resistance is reduced. The exhaust pipe 70 extends rearward passing through the right lateral side of the cylinder 42. A rear end of the exhaust pipe 70 is connected to the muffler 79 near the seat 32.

The exhaust pipe 70 is formed by connecting an upstream pipe 71, a diameter-enlarged pipe 72, the primary catalyst case 74, a diameter-reduced pipe 75, a downstream pipe 76, a diameter-enlarged pipe 77 (see FIG. 1), and the secondary catalyst case 78 (see FIG. 1). The upstream pipe 71 obliquely extends to a left and lower side from the exhaust port 47 and then is curved to toward the right side. The diameter-enlarged pipe 72 extends rightward from a downstream end of the upstream pipe 71, crosses the front side of the down frame 14, and then is obliquely curved to an upper and right side. A front half of the diameter-enlarged pipe 72 that crosses the down frame 14 is a straight portion 73 having a straight pipe shape. A rear half of the diameter-enlarged pipe 72 is curved while being enlarged in diameter from the straight portion 73 toward the downstream side.

A guard member 83 protrudes upward from the straight portion 73 of the diameter-enlarged pipe 72. A first oxygen sensor (exhaust gas sensor) 84 is attached to an upper surface of the straight portion 73 behind the guard member 83, in a front view. The first oxygen sensor 84 is positioned in front of the down frame 14. The first oxygen sensor 84 is sandwiched between the down frame 14 and the guard member 83 from the front and rear sides. The first oxygen sensor 84 is protected by the guard member 83 and the down frame 14. By attaching the first oxygen sensor 84 to the straight portion 73, deviation of the flow of the exhaust gas in the vicinity of a detection end of the first oxygen sensor 84 is reduced, thereby improving detection accuracy.

The primary catalyst case 74 and the diameter-reduced pipe 75 are integrally formed. The primary catalyst case 74 obliquely extends to an upper and right side from a downstream end of the diameter-enlarged pipe 72. The diameter-reduced pipe 75 is curved rearward from a downstream end of the primary catalyst case 74. The primary catalyst case 74 is formed to have a larger diameter than the upstream pipe 71. The primary catalyst 81 is accommodated inside the primary catalyst case 74. Air pollutants in the exhaust gas are purified as the exhaust gas passes through the primary catalyst 81. The diameter-reduced pipe 75 is curved while reducing in diameter from the primary catalyst case 74 toward the downstream.

The downstream side of the diameter-reduced pipe 75 is positioned on the lateral side of the cylinder 42. A second oxygen sensor 86 is attached to the diameter-reduced pipe 75 on the lateral side of the cylinder 42. A base end of the second oxygen sensor 86 faces inward in the vehicle width direction. A base end of the second oxygen sensor 86 is positioned in a space surrounded by the peripheral components such as the right radiator 51, the cylinder head 43, the inlet hose 62, and the diameter-reduced pipe 75. The second oxygen sensor 86 is protected by the peripheral components. The second oxygen sensor 86 is positioned at a downstream side of the diameter-reduced pipe 75 where the diameter is reduced, and even when the diameter-reduced pipe 75 is curved, the exhaust gas is not likely to hit a detection end of the second oxygen sensor 86, so that the detection accuracy will not be impaired.

The downstream pipe 76 extends rearward from the downstream end of the diameter-reduced pipe 75 and passes through the right lateral side of the cylinder 42. The diameter-enlarged pipe 77 is enlarged in diameter from the downstream end of the downstream pipe 76 toward the rear side. The secondary catalyst case 78 is formed to have a larger diameter than the downstream pipe 76. The secondary catalyst 82 (see FIG. 1) is accommodated inside the secondary catalyst case 78. Air pollutants in the exhaust gas are purified as the exhaust gas passes through the secondary catalyst 82. The muffler 79 is connected to the downstream end of the secondary catalyst case 78. Exhaust gas that passes through the secondary catalyst 82 is discharged from the muffler 79 to the outside.

The diameter-enlarged pipe 72 is formed in a hollow structure constituted by front and rear pipe halves. The primary catalyst case 74 and the diameter-reduced pipe 75 are also formed in a hollow structure constituted by left and right pipe halves. Therefore, mounting bosses for the first and second oxygen sensors 84, 86 can be easily provided on each of the pipe halves. The first oxygen sensor 84 is configured to detect an oxygen concentration in the exhaust gas. The second oxygen sensor 86 is configured to detect an oxygen concentration in the exhaust gas that passes through the primary catalyst 81. A detection result of the first oxygen sensor 84 is used for feedback control of a fuel injection amount, and a detection result of the second oxygen sensor 86 is used for diagnosing catalyst deterioration.

As shown in FIG. 4, a first lead wire 85 extends upward from a base end of the first oxygen sensor 84 (see FIG. 2), and a second lead wire 87 extends upward from the base end of the second oxygen sensor 86. The right radiator 51 is provided with a shroud 66 that covers the right radiator core 53, and the shroud 66 is provided with cable holders 67, 68. The first lead wire 85 is held by the suspension bracket 23 (see FIG. 3) of the down frame 14 and then extends toward the second oxygen sensor 86 and is held together with the first lead wire 85 by the cable holders 67, 68 of the shroud 66. By reducing vibration of the first and second lead wires 85, 87, damage to the first and second lead wires 85, 87 is prevented.

Figure 5:
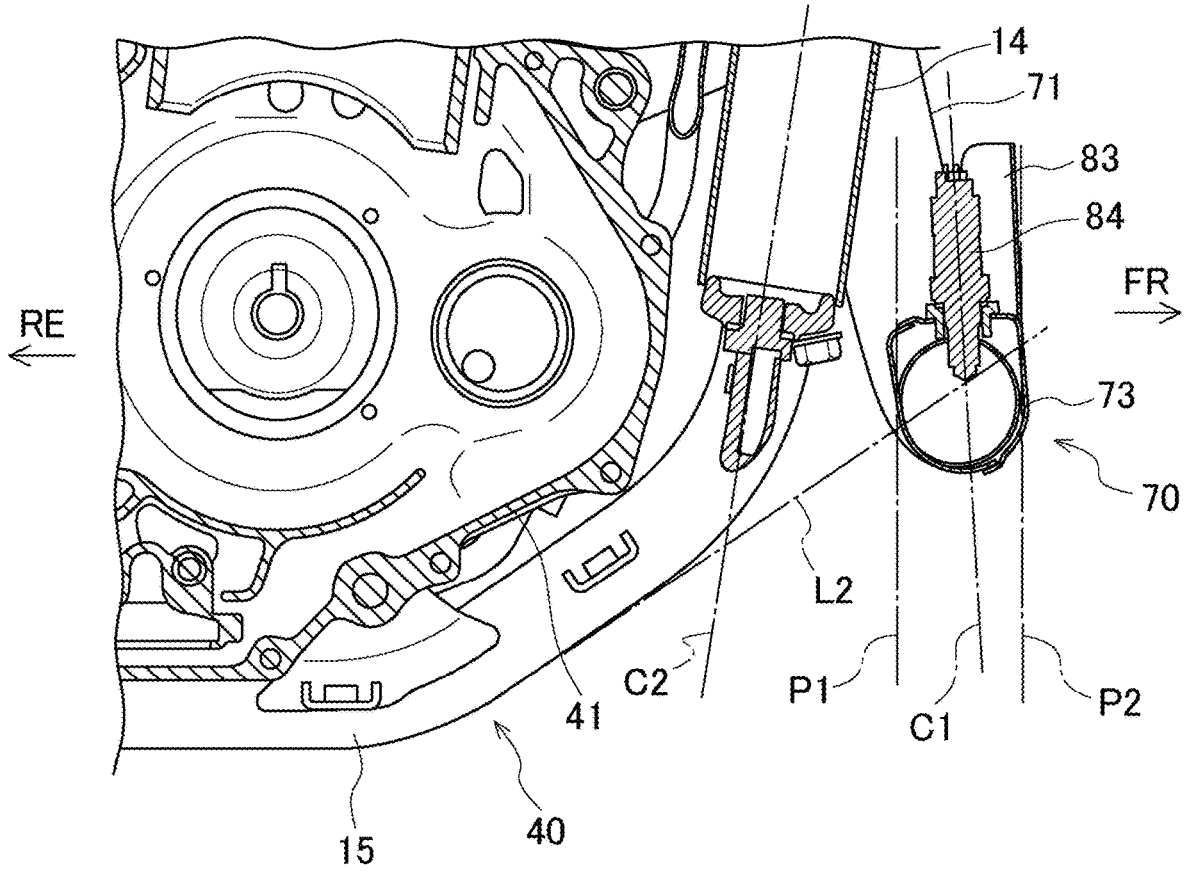
FIG. 5 is a cross-sectional view of the engine in FIG. 3 taken along a line V-V.
Figure 6:
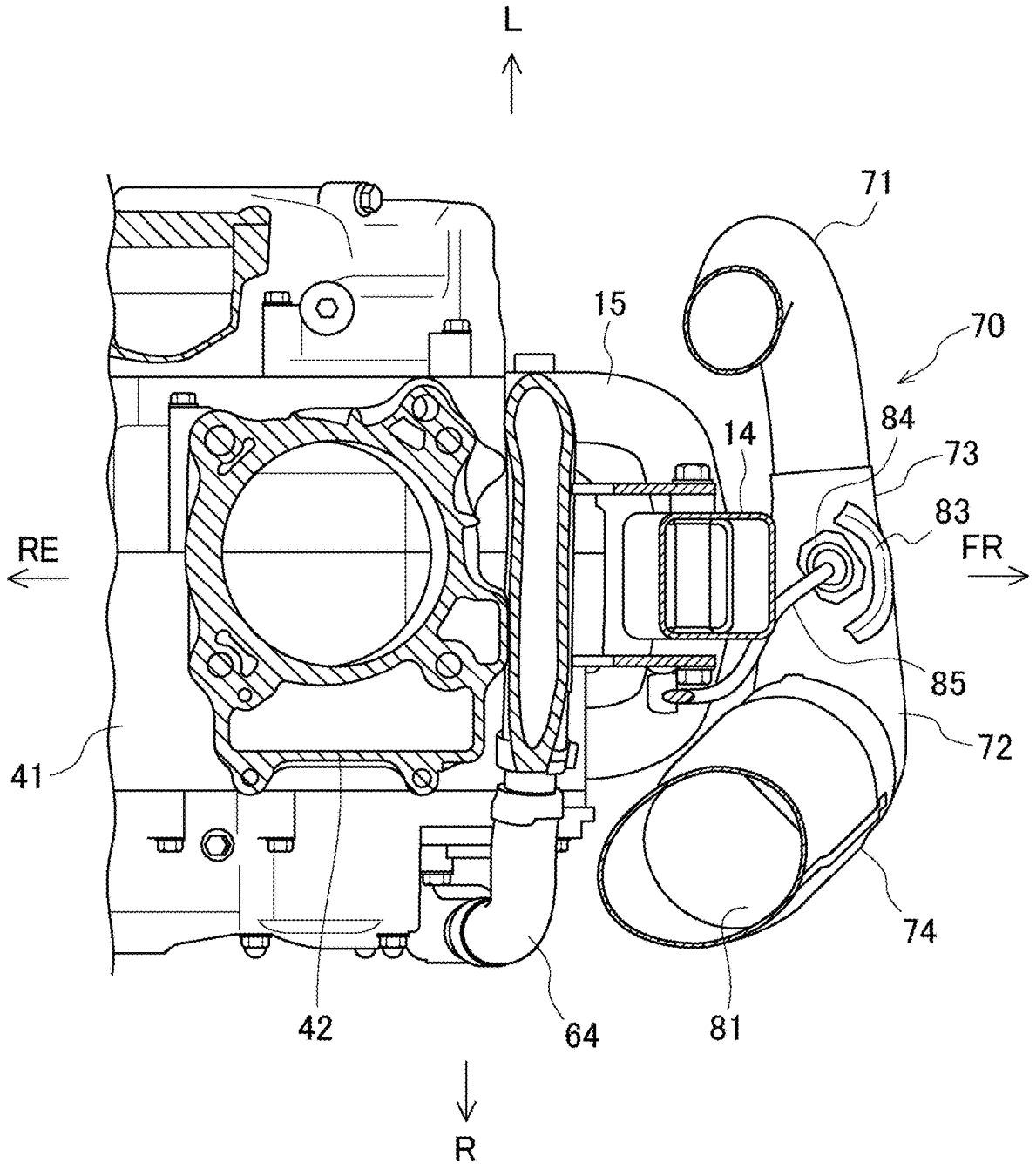
FIG. 6 is a cross-sectional view of the engine in FIG. 3 taken along a line VI-VI.

The layout of the first oxygen sensor will be described in detail with reference to FIGS. 3, 5, and 6. FIG. 5 is a cross-sectional view of the engine in FIG. 3 taken along a line V-V. FIG. 6 is a cross-sectional view of the engine in FIG. 3 taken along a line VI-VI.

As shown in FIG. 3, the straight portion 73 of the exhaust pipe 70 extends across the front side of the down frame 14 in the vehicle width direction. The guard member 83 protrudes from an upper surface of the straight portion 73. The first oxygen sensor 84 is attached to a back side of the guard member 83 from the upper surface of the straight portion 73. When passing over an obstacle, the straight portion 73 of the exhaust pipe 70 vibrates less than a bent portion, so that the first oxygen sensor 84 is supported stably. The first oxygen sensor 84 overlaps the down frame 14 from the front side, and the first oxygen sensor 84 is approximately perpendicular to the straight portion 73, so that the detection accuracy is stable.

In this case, an extension line L1 of an upper edge of the upstream pipe 71 is extended to the right lateral side, so that the diameter-enlarged pipe 72 is divided into upper and lower parts. The first oxygen sensor 84 is attached to a lower area of the diameter-enlarged pipe 72. The first oxygen sensor 84 is not attached to an upper area of the diameter-enlarged pipe 72. The lower area of the diameter-enlarged pipe 72 is the straight portion 73 where the flow rate of the exhaust gas is high, thereby improving exhaust gas exchange performance and reducing deviation of the flow of the exhaust gas. In the lower area of the diameter-enlarged pipe 72, the detection accuracy is improved by directing the detection end of the first oxygen sensor 84 approximately perpendicular to the flow of the exhaust gas.

In a front view, the first oxygen sensor 84 extends in a manner of being parallel to the down frame 14, and the first oxygen sensor 84 is positioned inside both side surfaces of the down frame 14 in an engine width direction. The first lead wire 85 extending from the base end (upper end) of the first oxygen sensor 84 can be easily routed along the down frame 14. The down frame 14 and the guard member 83 face each other in the front-rear direction. The first oxygen sensor 84 is sandwiched between the down frame 14 and the guard member 83. At the front side of the engine 40, the first oxygen sensor 84 is protected by the down frame 14 and the guard member 83 from the front and rear sides.

In a side view, the first oxygen sensor 84 overlaps the exhaust pipe 70 passing through both lateral sides of the down frame 14 (see FIG. 2). The upstream pipe 71 is positioned on the left lateral side of the first oxygen sensor 84. The primary catalyst case 74 is positioned on the right lateral side of the first oxygen sensor 84. The first oxygen sensor 84 is protected by the upstream pipe 71 and the primary catalyst case 74, thereby reducing the risk of damage to the first oxygen sensor 84 when the vehicle rolls over. As described above, the primary catalyst 81 is accommodated inside the primary catalyst case 74, and is positioned so that the primary catalyst 81 overlaps the first oxygen sensor 84 in a side view (see FIG. 2).

In this case, the primary catalyst 81 is positioned above a lower end of the down frame 14 and the under loop 15 and below the exhaust port 47. In a front view, an upper end of the primary catalyst 81 is inclined so as to be positioned outside a lower end of the primary catalyst 81 in the vehicle width direction. In a side view, the lower end of the primary catalyst 81 is inclined so as to be positioned in front of the upper end of the primary catalyst 81 (see FIG. 2). In a side view, the primary catalyst 81 overlaps the down frame 14, and the lower end of the primary catalyst 81 is positioned in front of the down frame 14 (see FIG. 2). By bringing the primary catalyst 81 closer to the first oxygen sensor 84, the first oxygen sensor 84 is activated early by utilizing the heat of the primary catalyst 81, so that the detection accuracy is improved.

As shown in FIG. 5, an axis C1 of the first oxygen sensor 84 is inclined so as to approach an axis C2 of the down frame 14, in a side view. Since the first oxygen sensor 84 is slightly inclined rearward, the risk of damage due to a collision with a flying stone or the like from the front side is reduced. The first lead wire 85 (see FIG. 6) can be easily routed along the down frame 14. In a side view, the axis C1 of the first oxygen sensor 84 extends approximately parallel to an axis of the front fork 25 (see FIG. 1), and the first oxygen sensor 84 is positioned inside both end positions P1, P2 of the straight portion 73 in the front-rear direction. Since the first oxygen sensor 84 does not protrude from the straight portion 73, a gap is ensured between the first oxygen sensor 84 and the down frame 14 or the front wheel 27, and there is no need to extend a wheelbase to attach the first oxygen sensor 84.

In a side view, the guard member 83 protrudes vertically from the straight portion 73, and an upper end of the guard member 83 is positioned above the base end of the first oxygen sensor 84. The first oxygen sensor 84 is inclined upward and away from the guard member 83. The further upward the first oxygen sensor 84 is, the farther it is away from the guard member 83, so that even in a case where the guard member 83 is hit by a flying stone or the like and deformed, influence on the first oxygen sensor 84 is reduced. Providing the gap between the first oxygen sensor 84 and the guard member 83 makes it easier to attach the first oxygen sensor 84 and to route the first lead wire 85.

The under loop 15 is curved downward and rearward from the down frame 14. When an extension line L2 of a lower edge of the under loop 15 is extended at a middle position of a curved portion of the under loop 15, the first oxygen sensor 84 is positioned above the extension line L2. Since the first oxygen sensor 84 is positioned above the extension line L2 of the under loop 15, the exhaust pipe 70 (straight portion 73) is positioned higher. Therefore, when the straddle-type vehicle 1 passes over an obstacle, the first oxygen sensor 84 does not hit the obstacle, and even when the exhaust pipe 70 interferes with the obstacle and is dented, the risk of damage to the first oxygen sensor 84 is reduced.

As shown in FIG. 6, the guard member 83 is formed in an arc shape when viewed from above, and the first oxygen sensor 84 is positioned between the guard member 83 and the down frame 14. The guard member 83 and the down frame 14 are brought close to the first oxygen sensor 84 from the front and rear sides, and the first oxygen sensor 84 is covered by the down frame 14 from the rear side, so that it is not necessary to form the guard member 83 around the entire periphery. The guard member 83 is no longer necessary behind the first oxygen sensor 84, and a working space is ensured between the down frame 14 and the guard member 83 when the first oxygen sensor 84 is attached with a tool, thereby preventing deterioration of the ease of assembly.

As described above, according to the engine 40 of the present invention, the first oxygen sensor 84 is attached to the straight portion 73 where the flow of the exhaust gas is less deviated, and the first oxygen sensor 84 overlaps the down frame 14 from the front side and is approximately perpendicular to the straight portion 73. The detection accuracy is improved by directing the detection end of the first oxygen sensor 84 approximately perpendicular to the flow of the exhaust gas. The straight portion 73 of the exhaust pipe 70 vibrates less than a bent portion, allowing the first oxygen sensor 84 to be stably supported, and the first oxygen sensor 84 is positioned on the inside in the vehicle width direction, thereby reducing the risk of damage to the first oxygen sensor 84 when the vehicle rolls over. By routing the first lead wire 85 along the down frame 14, it is possible to prevent vibration of the first lead wire 85 and reduce the risk of damage to the first lead wire 85.

Note that in the present embodiment, the exhaust pipe extends downward from the cylinder head, and the exhaust pipe is largely curved in front of the crank case, and then extends rearward passing through the lateral side of the cylinder, but the exhaust pipe may extend rearward from the cylinder head passing through the lateral side of the cylinder. For example, the exhaust pipe may extend from the cylinder head toward a lateral side and then extend rearward passing through the lateral side of the cylinder.

In the present embodiment, an oxygen sensor is used as an example of an exhaust gas sensor, but the exhaust gas sensor may be any sensor capable of detecting average characteristics of the exhaust gas, and may be, for example, an exhaust temperature sensor that detects an exhaust temperature of the exhaust gas.

In the present embodiment, the first oxygen sensor serving as an exhaust gas sensor is attached to the straight portion of the diameter-enlarged pipe, but the exhaust gas sensor may be attached to the straight portion of the exhaust pipe that crosses the down frame.

In the present embodiment, the first and second oxygen sensors serving as exhaust gas sensors are provided in the exhaust pipe, but it is sufficient that at least one exhaust gas sensor is provided in the exhaust pipe.

In the present embodiment, the exhaust pipe is provided with the primary catalyst case and the secondary catalyst case, but it is sufficient that the exhaust device is provided with at least one catalyst case.

In the present embodiment, the vehicle frame is provided with an under loop, but the shape of the vehicle frame is not particularly limited as long as an under frame extends downward from at least the head pipe in the vehicle frame.

In the present embodiment, a water-cooled engine is exemplified as the engine, but the engine may be an air-cooled engine or an oil-cooled engine.

The exhaust pipe in the present embodiment may be a single pipe or a double pipe.

The engine of the present embodiment is not limited to being used in the off-road type straddle-type vehicle described above, and may be used in other types of straddle-type vehicles. Note that the straddle-type vehicle is not limited to a general vehicle in which a driver rides on a seat in a posture straddling the seat, and includes a scooter-type vehicle in which the driver rides on the seat without straddling the seat.

As described above, a first aspect is an engine (40) for a straddle-type vehicle (1) to be mounted on a vehicle frame (10) in which a down frame (14) extends downward from a head pipe (11), the engine including: a cylinder head (43) having an exhaust port (47) formed therein; an exhaust pipe (70) connected to the exhaust port of the cylinder head; and an exhaust gas sensor (first oxygen sensor 84) attached to the exhaust pipe, in which the exhaust pipe extends downward passing through one lateral side of the down frame, crosses a front side of the down frame, and then extends upward passing through the other lateral side of the down frame, a part of the exhaust pipe that crosses the down frame is a straight portion (73), and the exhaust gas sensor is attached to the straight portion and overlaps the down frame from the front side. According to this configuration, the exhaust gas sensor is attached to the straight portion where the flow of exhaust gas is less deviated, and the exhaust gas sensor overlaps the down frame from the front side and is approximately perpendicular to the straight portion. The detection accuracy is improved by directing the detection end of the exhaust gas sensor approximately perpendicular to the flow of the exhaust gas. The straight portion of the exhaust pipe vibrates less than a bent portion, allowing the exhaust gas sensor to be stably supported, and the exhaust gas sensor is positioned on the inside in the vehicle width direction, thereby reducing the risk of damage to the exhaust gas sensor when the vehicle rolls over. By routing the lead wire of the exhaust gas sensor along the down frame, it is possible to prevent vibration of the lead wire and reduce the risk of damage to the lead wire.

In a second aspect, according to the first aspect, in a front view, the exhaust gas sensor extends in an upper-lower direction in a manner of being parallel to the down frame, and the exhaust gas sensor is positioned inside both side surfaces of the down frame in an engine width direction. According to this configuration, the exhaust gas sensor is attached approximately perpendicular to the straight portion of the exhaust pipe, thereby making it possible to further improve the detection accuracy. The lead wire of the exhaust gas sensor can be easily routed along the down frame.

In a third aspect, according to the first aspect and the second aspect, in a side view, an axis of the exhaust gas sensor is inclined upward in a manner of approaching an axis of the down frame. According to this configuration, the risk of damage to the exhaust gas sensor due to a collision with a flying stone or the like from the front side is reduced by being inclined rearward. The lead wire of the exhaust gas sensor can be easily routed along the down frame, and by routing the lead wire along the down frame, vibration of the lead wire can be prevented.

In a fourth aspect, according to any one aspect of the first aspect to the third aspect, the exhaust gas sensor is positioned inside both ends of the straight portion in a front-rear direction in a side view. According to this configuration, the exhaust gas sensor does not protrude forward or rearward from the straight portion, so that a gap is ensured between the exhaust gas sensor and the down frame or the front wheel, and there is no need to extend the wheelbase to attach the exhaust gas sensor.

In a fifth aspect, according to any one aspect of the first aspect to the fourth aspect, the exhaust gas sensor overlaps the exhaust pipe passing through both lateral sides of the down frame in a side view. According to this configuration, the exhaust gas sensor is protected from both lateral sides by the exhaust pipe, and the risk of damage to the exhaust gas sensor due to the vehicle rolling over or the like can be reduced.

In a sixth aspect, according to any one aspect of the first aspect to the fifth aspect, a catalyst (primary catalyst 81) is accommodated in the exhaust pipe on the other lateral side of the down frame, and the catalyst overlaps the exhaust gas sensor in a side view. According to this configuration, by bringing the catalyst closer to the exhaust gas sensor, the heat of the catalyst can be utilized to activate the exhaust gas sensor early, thereby improving the detection accuracy.

In a seventh aspect, according to any one aspect of the first aspect to the sixth aspect, a guard member (83) protrudes from the straight portion, and the exhaust gas sensor is covered by the guard member from the front side. According to this configuration, the exhaust gas sensor is covered by the guard member from the front side, and the exhaust gas sensor is protected by the guard member, thereby reducing the risk of damage.

In an eighth aspect, according to the seventh aspect, the guard member protrudes vertically from the straight portion in a side view, and the exhaust gas sensor is inclined upward in a manner of being away from the guard member. According to this configuration, the further upward the exhaust gas sensor is, the farther it is away from the guard member, so that even when the guard member is hit by a flying stone or the like and deformed, influence on the exhaust gas sensor is reduced. Providing a gap between the exhaust gas sensor and the guard member makes it easier to attach the exhaust gas sensor and to route the lead wire.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An engine for a vehicle, the straddle-type-vehicle to be mounted on a vehicle frame in which a down frame, having a pair of side surfaces, extends downward from a head pipe, the engine comprising:

a cylinder head having an exhaust port formed thereon;

an exhaust pipe connected to the exhaust port of the cylinder head; and an exhaust gas sensor attached to the exhaust pipe, wherein the exhaust pipe extends downward passing through a first lateral side of the down frame, crosses a front side of the down frame, and extends upward passing through a second lateral side of the down frame, a part of the exhaust pipe that crosses the down frame is a straight portion, the exhaust gas sensor is attached to the straight portion and overlaps, in a front view, the down frame from the front side, wherein in the front view, the exhaust gas sensor extends in an upper-lower direction so as to be parallel to the down frame, and in the front view, in an engine width direction, the exhaust gas sensor is positioned between both of the pair of side surfaces of the down frame, the pair of side surfaces extending in parallel to each other.

2. The engine according to claim 1, wherein in a side view, an axis of the exhaust gas sensor is inclined upward so as to be close to an axis of the down frame.

3. The engine according to claim 1, wherein in a side view, the exhaust gas sensor is positioned inside both ends of the straight portion in a front-rear direction.

4. The engine according to claim 1, wherein in a side view, the exhaust gas sensor overlaps the exhaust pipe passing through both lateral sides of the down frame.

5. The engine according to claim 1, wherein a catalyst is accommodated in the exhaust pipe, on the second lateral side of the down frame, and in a side view, the catalyst overlaps the exhaust gas sensor.

6. The engine according to claim 1, wherein a guard member protrudes from the straight portion, and the guard member covers the exhaust gas sensor from a front side.

7. The engine according to claim 6, wherein in a side view, the guard member protrudes vertically from the straight portion, and the exhaust gas sensor is inclined upward so as to be away from the guard member.

* * * * *